US005108675A

United States Patent [19]

Matsuo et al.

[11] Patent Number: 5,108,675

[45] Date of Patent: Apr. 28, 1992

[54] PROCESS FOR PREPARING EASILY DYEABLE POLYETHYLENE TEREPHTHALATE FIBER

[75] Inventors: Teruhiko Matsuo; Hiroyuki Makino, both of Nobeoka, Japan

[73] Assignee: Asahi Kasei Kogyo Kabushiki Kaisha, Osaka, Japan

[21] Appl. No.: 485,768

[22] Filed: Feb. 26, 1990

Related U.S. Application Data

[60] Division of Ser. No. 320,816, Mar. 10, 1989, abandoned, which is a continuation of Ser. No. 21,572, Mar. 3, 1987, abandoned, which is a continuation of Ser. No. 761,304, Jul. 30, 1985, abandoned, which is a continuation of Ser. No. 498,1741, May 27, 1983, abandoned.

[30] Foreign Application Priority Data

May 28, 1982 [JP] Japan ..... 57-89753
May 28, 1982 [JP] Japan ..... 57-89754

[51] Int. Cl.[5] ..... D01F 6/62

[52] U.S. Cl. ..... 264/103; 264/130; 264/210.8; 264/211.17

[58] Field of Search ..... 264/211.17, 210.8, 130, 264/103

[56] References Cited

U.S. PATENT DOCUMENTS

| | | | |
|---|---|---|---|
| 2,604,667 | 7/1952 | Hebeler | 264/210.8 |
| 3,361,859 | 5/1966 | Cenzato | 264/210.8 |
| 3,527,862 | 9/1970 | Shimosako et al. | 264/290 |
| 3,771,307 | 11/1973 | Petrillo | 57/157 |
| 3,969,462 | 7/1976 | Stofan | 264/210.8 |
| 3,988,086 | 10/1976 | Marshall et al. | 264/210.8 |
| 4,049,763 | 9/1977 | Mineo et al. | 264/210.8 |
| 4,134,882 | 1/1979 | Frankfort et al. | 264/176 F |
| 4,156,071 | 5/1979 | Knox | 264/210 F |
| 4,195,051 | 3/1980 | Frankfort et al. | 264/176 F |
| 4,195,052 | 3/1980 | Davis et al. | 264/210.8 |
| 4,390,685 | 6/1983 | Oka et al. | 264/210.8 |
| 4,414,169 | 11/1983 | McClary | 264/210.8 |
| 4,415,726 | 11/1983 | Tanji et al. | 528/272 |
| 4,426,516 | 1/1984 | Kuriki et al. | 528/308.1 |

FOREIGN PATENT DOCUMENTS

| | | |
|---|---|---|
| 2741193 | 3/1979 | Fed. Rep. of Germany . |
| 51-7216 | 2/1976 | Japan . |
| 4569914 | 8/1978 | Japan . |
| 684046 | 12/1952 | United Kingdom . |
| 735171 | 8/1955 | United Kingdom . |
| 903913 | 8/1962 | United Kingdom . |
| 2002680 A | 2/1979 | United Kingdom . |
| 2002681 | 2/1979 | United Kingdom . |

OTHER PUBLICATIONS

Kamide et al., "Regulation of the Amorphous Supermolecular Structure of High-Speed-Spun Poly(ethylene terephthalate) Fibers by High Temperature Short Period Heat-Treatment", Polymer Journal vol. 18, No. 2, 1986, pp. 163-166.

Condensed Chemical Dictionary, 10th Ed. 1981, p. 832.

Jiro Shimizu and Norimasa Okui, Sen-I Gakkaishi, "Effect of Inertial Stress on Formation of Fiber Structure in High Speed Melt Spinning", vol. 39, No. 11, (1983) pp. T-445-T-450.

*Primary Examiner*—Hubert C. Lorin
*Attorney, Agent, or Firm*—Finnegan, Henderson, Farabow, Garrett & Dunner

[57] ABSTRACT

Fine polyethylene terephthalate fiber having a monofilament denier of not more than about 4 deniers is spun at a high spinning speed of not less than 7,000 m/min, the polyethylene terephthalate filaments extruded from a spinneret having a plurality of spinning holes being passed through a heating zone provided beneath the spinneret and then being bundled by a bundling guide positioned beneath the point of completion of filament fining, which point exists within or below the heating zone. The obtained fiber has a highly improved dyeability.

5 Claims, 5 Drawing Sheets

PROCESS FOR PREPARING EASILY DYEABLE POLYETHYLENE TEREPHTHALATE FIBER

This application is a division of application Ser. No. 07/320,816, filed Mar. 10, 1989, which is a continuation, of application Ser. No. 07/021,572, filed Mar. 3, 1987, which is a continuation of Ser. No. 06/761,304, filed Jul. 30, 1985, which is a continuation of Ser. No. 06/498,741, filed May 27, 1983.

BACKGROUND OF THE INVENTION

1. Field of the Invention

The invention relates to a polyethylene terephthalate fiber of improved dyeability and to a process for the preparation thereof. More particularly, the invention relates to an easily dyeable polyethylene terephthalate fiber which can be dyed at 100° C., i.e., under normal pressure, without the use of a carrier after being false twisted and to a process for preparing the fiber by high-speed spinning at a spinning speed of not less than 7,000 m/min.

2. Description of the Prior Art

Polyethylene terephthalate fibers are widely used in the garment industry. They are, however, poor in dyeability, and, thus, it is necessary to dye them by using a high-pressure dyeing machine at a high temperature of about 130° C. and under a high pressure or by using a carrier of an organic solvent. High-temperature and high-pressure dyeing has disadvantages in that much energy is necessary and in that the fibers cannot be substantially used in combination with other fibers, such as wool, acrylic fibers, or polyurethane fibers, which fibers are degraded during high-temperature and high-pressure dyeing. On the other hand, carrier dyeing has disadvantages in that, due to the use of an organic solvent as the carrier, the process is complicated, the odor of the used solvent remains on the product, and treatment of the waste liquor is difficult.

Therefore, it is very advantageous if a polyethylene terephthalate fiber which can be dyed at a temperature lower than 130° C. can be obtained. Particularly, if it is possible to dye a polyethylene terephthalate fiber at a temperature not higher than 100° C., i.e., under normal pressure, the following advantages can be attained: energy can be saved, the use of a carrier is unnecessary, and excellent new textiles, such as mixed knitted or woven fabrics, can be obtained since the polyethylene terephthalate fibers can be used in combination with other fibers such as wool, acrylic fibers, or polyurethane fibers which are degraded by dyeing at 130° C. Therefore, the utility of the polyethylene terephthalate fibers can be increased.

Such an easily dyeable polyethylene terephthalate fiber has another advantage in that the use of an expensive high-pressure dyeing machine, the control of which is complicated, is unnecessary, i.e., an inexpensive and simple dyeing machine such as a jigger can be used.

A method in which a third component, such as a compound having a metal sulfonate group, is copolymerized with polyethylene terephthalate is known as a method for improving the dyeability of a polyethylene terephthalate fiber. However, in this method, the thermal and mechanical properties, such as the melting point and strength, inherent to polyethlene terephthalate may be deteriorated. In addition, it is still impossible to dye the resultant fiber in combination with wool, an acrylic fiber, or a polyurethane fiber without the use of a carrier. Further, such a copolymerized polyethylene terephthalate may often have a poor light fastness when dyed.

Japanese Examined Patent Publication (Kokoku) No. 35-3104 discloses that highly oriented filaments having practical, satisfactory properties can be obtained by high-speed spinning, in which melt-spun polyethylene terephthalate filaments are taken up at a speed of not less than 4,000 m/min even if the filaments are not subjected to drawing. U.S. Pat. Nos. 4,156,071, 4,134,882, and 4,195,051 and Seni Gakkaishi, 37, No. 4, pages T135 to T142 (1981) disclose that polyethylene terephthalate fibers obtained by high-speed spinning at not less than 4,000 m/min have a higher dyeability than do polyethylene terephthalate fibers obtained by a conventional process in which polyethylene terephthalate is melt spun at a low speed and the resultant filaments are then subjected to drawing.

The polyethylene terephthalate fiber disclosed in U.S. Pat. No. 4,156,071 has a high dyeability since it is spun at a speed of about 4,000 m/min. However, the fiber has a serious practical disadvantage in that the fiber is elongated by a relatively low load at the weaving or knitting step due to the low first yield stress, and, thus, a fabric obtained from the fiber may often have uneven dyeing or a poor quality. Also, the fiber has an initial modulus of about 50 g/d, which is approximately equal to that of a cellulose acetate fiber and, thus, does not maintain excellent hands inherent to a conventional polyethylene terephthalate fiber.

The polyethylene terephthalate fiber disclosed in U.S. Pat. No. 4,134,882 has a long period of not less than 300 Å, a low distribution of birefringence across the transverse cross section of a filament, and a high dyeability. This fiber may be prepared by a process disclosed in U.S. Pat. No. 4,195,051, in which process a spinneret having nozzles of a length diameter ratio larger than usual is used and spun filaments are taken up at a speed of not less than 5,200 yards/min (i.e., 4,700 m/min). In these two U.S. patents, examples are given in which spinning is carried out at a speed of from 4,950 m/min to 7,200 m/min. However, in the disclosed process, the higher the spinning speed, the greater the air drag, with the result that yarn breakage may often occur. In order to avoid this problem, it is necessary to decrease the fineness of the filaments to be spun (i.e., decrease the surface area per unit weight) as the spinning speed is increased. It has conventionally been impossible to obtain a polyethylene terephthalate filament fiber having a fineness of not more than 4 deniers, i.e., a surface area per unit weight of not less than 1,400 $cm^2/g$, which is suitable for making garments at a spinning speed of not less than 7,000 m/min. In addition, the polyethylene terephthalate fiber obtained by this process cannot have a dyeability enabling it to be dyed under normal pressure even after the fiber is false twisted.

By the process disclosed in Seni Gakkaishi, 37, No. 4, pages T135 to T142 (1981), in which process polyethylene terephthalate is spun at a high speed while cooling the as-spun filaments with cooling air of −2° C. immediately after extrusion from the spinneret, a polyethylene terephthalate filament fiber of a fineness of not less than 5.8 deniers (i.e., a surface area per unit weight of not more than 1190 $cm^2/g$) can be obtained at a spinning speed of from 7,000 m/min to 9,000 m/min. This publication further discloses that the polyethylene terephthalate fiber obtained at a spinning speed of not less than 7,000 m/min has a high dyeability which is further improved as the spinning speed increases. However, the fiber cannot have a dyeability enabling it to be dyed under normal pressure even after false twisting is carried out.

As was mentioned above, in known high-speed spinning processes, it is impossible to spin a polyethylene terephthalate filament fiber having a fineness of not more than about 4 deniers at a speed of not less than 7,000 m/min, and, thus, a polyethylene terephthalate fiber which can be dyed under normal pressure after false twisting cannot be obtained.

Japanese Unexamined Patent Publication (Kokai) No. 51-7216 discloses a process for preparing a polyester fiber at a spinning speed of from 2,000 m/min to 5,000 m/min, in which process the as-spun filaments are bundled at a point not more than 25 cm beneath the hardening point (i.e., the point of completion of fining) of the filaments. However, even if the process as such is applied in high-speed spinning of not less than 7,000 m/min, spinning is impossible due to the frequent occurrence of yarn breakage. This publication is completely silent concerning means for making possible spinning at a speed of not less than 7,000 m/min.

SUMMARY OF THE INVENTION

It is an object of the present invention to provide a polyethylene terephthalate fiber from which a false-twisted fiber which can be dyed under normal pressure can be obtained.

It is another object of the present invention to provide a process for preparing a polyethylene terephthalate fiber having a fineness of not more than about 4 deniers, i.e., a surface area per unit weight of not less than 1,400 $cm^2/g$, at a spinning speed of not less than 7,000 m/min.

It is a further object of the present invention to provide a process for preparing a polyethylene terephthalate fiber in which a spun fiber is taken up into a package of a high package form quality under a low winding tension without using godet rolls.

The inventors have made extensive studies in an attempt to attain the above-mentioned objects and have found that if extruded polyethylene terephthalate filaments are passed through a heating zone provided beneath a spinneret, the heating zone having a certain temperature, and then are bundled by a bundling guide positioned beneath the point of completion of fining of the filaments, which point exists within or below the heating zone, the stability of spinning at a high speed is extremely improved. Thus, it is possible to effect the spinning of a fine polyethylene terephthalate fiber having a monofilament denier of not more than about 4 deniers (i.e., a surface area per unit weight of not less than 1,400 $cm^2/g$) at a spinning speed of not less than 7,000 m/min, and the obtained fiber has a highly improved dyeability.

Thus, the present invention provides an easily dyeable polyethylene terephthalate fiber having an intrinsic viscosity of the polymer of from 0.50 to 1.0, an initial modulus of from 60 g/d to 130 g/d, a surface area per unit weight of from 1,400 $cm^2/g$ to 4,000 $cm^2/g$, and a peak temperature ($T_{max}$) at which the dynamic loss tangent (tan δ) measured at a frequency of 110 Hg becomes maximum and a maximum tan δ value $(\tan\delta)_{max}$ satisfying the following relationship (1) or (2):

$$105^\circ\text{ C.} < T_{max} \leqq 115^\circ\text{ C. and } 0.135 < (\tan\delta)_{max} \leqq 0.190 \quad (1)$$

$$110^\circ\text{ C.} < T_{max} \leqq 115^\circ\text{ C. and } 0.110 \leqq (\tan\delta)_{max} \leqq 0.135 \quad (2)$$

The easily dyeable polyethylene terephthalate fiber is prepared, according to the present invention, by a process comprising melt-spinning polyethylene terephthalate through a spinneret having a plurality of spinning holes at a spinning speed of not less than 7,000 m/min, in which process a group of extruded filaments is passed through a heating zone defined over a length of not less than 5 cm from the bottom surface of the spinneret, is maintained at a temperature of from 150° C. to 300° C., and then is bundled into a filament bundle by means of a bundling guide positioned so as to satisfy the following conditions (a) and (b):

(a) the position should be not less than 5 cm beneath the point of completion of fining of the group of filaments (b) the tension imposed on the filament bundle 5 cm beneath the bundling guide should be not more than 0.4 g/d.

DESCRIPTION OF THE PREFERRED EMBODIMENTS

Figure 1:
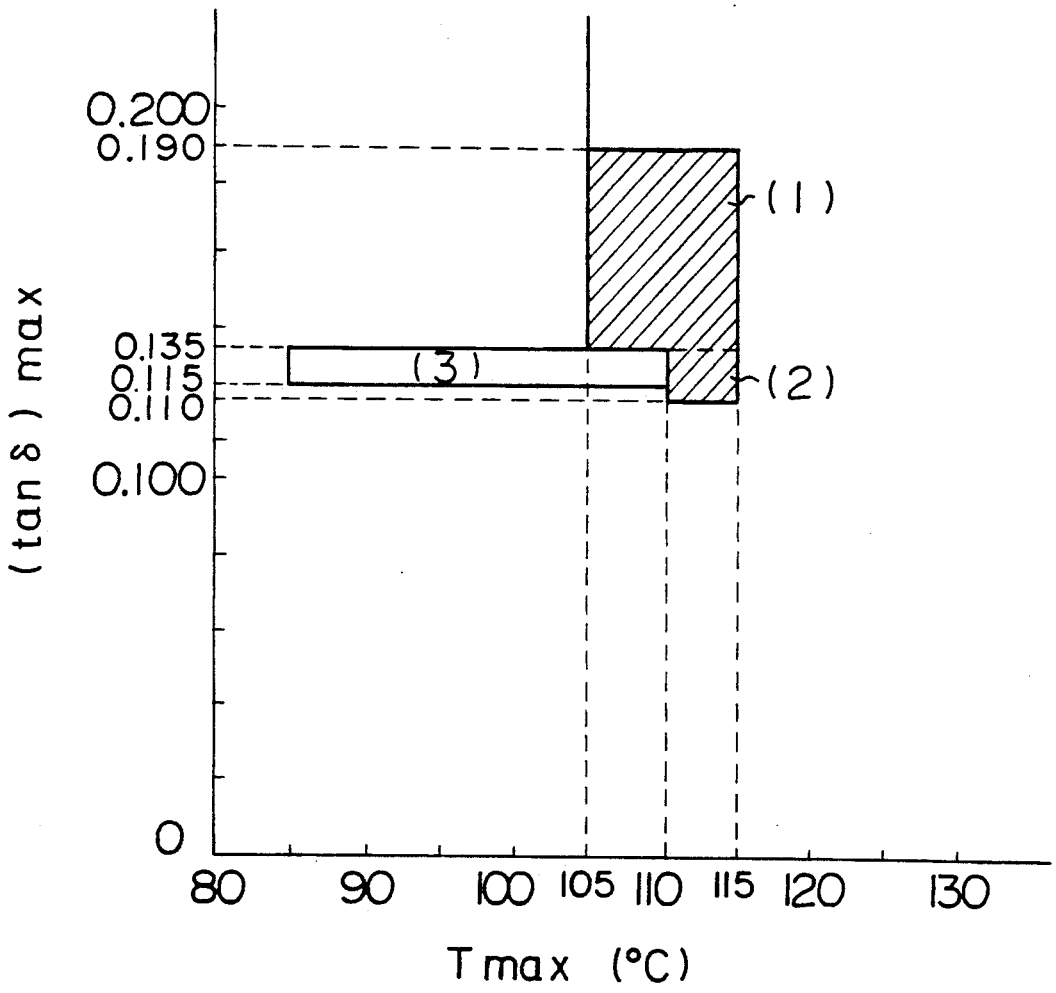
FIG. 1 is a graph illustrating the relationships of $T_{max}$ values and $(\tan\delta)_{max}$ values.

The process for preparing a polyethylene terephthalate fiber according to the present invention will now be described in detail with reference to FIG. 2. Molten polyethylene terephthalate is extruded from a spinneret 2, having a plurality of holes and provided in a heated spinhead 1, into a group of filaments 4. The filament group 4 is passed through a heating zone defined in a heating cylinder 3 while being gradually fined, is cooled by cooling air 6, and then is bundled and oiled by an oiling nozzle guide 5. Fining of the individual filaments of the filament group 4 is suddenly completed above the oiling nozzle guide 5, which fining is explained hereinafter. Thus, the oiling nozzle guide or bundling guide is positioned not less than 5 cm beneath the point of completion of fining of the filaments, and, in addition, the filament bundle receives a tension of not more than 0.4 g/d 5 cm beneath the oiling nozzle guide or bundling guide. The filament bundle is then taken up by a take-up unit 7.

The polyethylene terephthalate usable for the present invention may be prepared by known polymerization processes and may optionally contain a thermal stabilizer, a flatting agent, ar anti-static agent, or the like.

The polyethylene terephtharate should have an intrinsic viscosity of from 0.50 to 1.0. If the intrinsic viscosity is less than 0.50, the resultant polyethylene terephthalate fiber may have a low strength so that the fiber cannot be utilized for garments. If the intrinsic viscosity is more than 1.0, melt spinning at a high speed may be impossible. Preferably, the polyethylene terephthalate has an intrinsic viscosity of from 0.55 to 0.70.

The polyethylene terephthalate fiber according to the present invention should have an initial modulus of from 60 g/d to 130 g/d, preferably from 70 g/d to 120 g/d. If the initial modulus is less than 60 g/d, the polyethylene terephthalate fiber may lose excellent hands inherent to a conventional polyethylene terephthalate fiber and have a poor resiliency after the false twisting thereof. On the other hand, a polyethylene terephthalate fiber having an initial modulus of 130 g/d cannot be obtained without subjecting the fiber to drawing even if the spinning speed and the intrinsic viscosity of the polymer are selected within any range.

The polyethylene terephthalate fiber has a surface area per unit weight of from 1,400 $cm^2/g$ to 4,000 $cm^2/g$, preferably from 1,600 $cm^2/g$ to 3,000 $cm^2/g$, more preferably from 1,900 $cm^2/g$ to 3,000 $cm^2/g$. In the case of a filament having a circular cross section, the surface area per unit weight may be calculated from a fineness D (denier) and a density $\rho$ ($g/cm^3$) according to the following equation:

$$\text{Surface area per unit weight } (cm^2/g) = 2\sqrt{\frac{900{,}000\,\pi}{\rho D}} \quad \text{(I)}$$

In the case of a filament having a noncircular cross section, the surface area per unit weight may be calculated from the peripheral length l (cm) of the cross section of the filament determined from a micrograph of the cross section, a density $\rho$ ($g/cm^3$), and a fineness D (denier) according to the following equation:

$$\text{Surface area per unit weight } (cm^2/g) = 900{,}000\ l/D \quad \text{(II)}$$

If the surface area per unit weight is less than 1,400 $cm^2/g$, the fiber has a poor dyeability and cannot be dyed under normal pressure after the false twisting thereof. On the other hand, a polyethylene terephthalate fiber having a surface area per unit weight of more than 4,000 $cm^2/g$ cannot be obtained by high-speed spinning of more than 7,000 m/min.

Further, the polyethylene terephthalate fiber according to the present invention has a peak temperature ($T_{max}$) at which the dynamic loss tangent (tan $\delta$) measured at a frequency of 110 Hz becomes maximum and a maximum tan $\delta$ value $(\tan\delta)_{max}$ satisfying one of the following relationships:

$$105^\circ\text{ C.} < T_{max} \leqq 115^\circ\text{ C. and } 0.135 < (\tan\delta)_{max} \leqq 0.190 \quad (1)$$

$$110^\circ\text{ C.} < T_{max} \leqq 115^\circ\text{ C. and } 0.110 \leqq (\tan\delta)_{max} \leqq 0.135 \quad (2)$$

The above-mentioned ranges (1) and (2) are represented by oblique lines in FIG. 1, in which the area (1) corresponds to the range (1) above and the area (2) corresponds to the range (2) above. In this connection, it should be noted that the polyethylene terephthalate fiber described and claimed in our co-pending U.S. patent application Ser. No. 340,895, filed on Jan. 19, 1982 (corresponding to European Patent Application No. 82100289.6 filed on Jan. 16, 1982), has a peak temperature ($T_{max}$) and a maximum tan $\delta$ value $(\tan\delta)_{max}$ falling within the following range:

$$85^\circ\text{ C.} \leqq T_{max} \leqq 110^\circ\text{ C. and } 0.115 \leqq (\tan\delta)_{max} \leqq 0.135$$

This range is indicated by (3) in FIG. 1. Therefore, the fiber of the present invention is clearly different from the fiber in the above-mentioned co-pending application.

A polyethylene terephthalate fiber having a $T_{max}$ greater than 115° C. or greater than 110° C. but not greater than 115° C. and a $(\tan\delta)_{max}$ less than 0.110 has a poor dyeability so that a false-twisted fiber obtained therefrom cannot be dyed at 100° C. and be practically acceptable even if the fiber has a surface area per unit weight within any range. A polyethylene terephthalate having a $T_{max}$ not greater than 110° C. and a $(\tan\delta)_{max}$ not greater than 0.135 has a good dyeability but is difficult to stably produce unless the intrinsic viscosity of the polyethylene terephthalate is less than 0.50 since yarn breakage often occurs during spinning. On the other hand, if the intrinsic viscosity of the polyethylene terephthalate is less than 0.5, yarn breakage often occurs during false twisting. A polyethylene terephthalate fiber having a $T_{max}$ not greater than 105° C. and a $(\tan\delta)_{max}$ greater than 0.135 has a good dyeability but a low first yield stress before and after false twisting so that the fiber may easily be elongated by a relatively low load, and, thus, the disappearance of crimp and uneven dyeing may often result. Further, a polyethylene terephthalate fiber having a $T_{max}$ greater than 105° C. but not greater than 115° C. and a $(\tan\delta)_{max}$ greater than 0.190 has a poor dyeability and, thus, cannot be dyed under normal pressure even after false twisting or has too low an initial modulus, i.e., less than 60 g/d.

Preferably, the polyethylene terephthalate fiber has a $T_{max}$ within a range of $105^\circ\text{ C.} < T_{max} \leqq 113^\circ\text{ C.}$ and a $(\tan\delta)_{max}$ within a range of $0.135 < (\tan\delta)_{max} \leqq 0.180$.

In the present invention, the easily dyeable polyethylene terephthalate fiber is prepared by melt spinning the polymer through a spinneret, having a plurality of holes, at a spinning speed of not less than 7,000 m/min. Conventional known spinnerets may be employed. The spinning speed is the running speed of the filament bundle after the completion of filament fining, which speed is identical to the take-up speed in a case where no godet rolls are used.

In the process according to the present invention, the polyethylene terephthalate filaments extruded from the spinneret are passed through a heating zone defined over a length of not less than 5 cm from the bottom surface of the spinneret and are maintained at a temperature of from 150° C. to 300° C. Such a heating zone may be formed by providing below the spinneret a cylindrical heater having an inner diameter corresponding to the number of extruded filaments and the arrangement of the spinneret holes or by feeding a heating fluid over a length of not less than 5 cm from the bottom surface of the spinneret. If the heating zone is less than 5 cm, stable spinning cannot be carried out at a high speed. The upper limit of the length of the heating zone is not critical, but a length of not more than 100 cm is preferred from the viewpoints of economy and ease in operation of the apparatus. The optimum length of the heating zone may depend on the intrinsic viscosity of the polymer, the extrusion temperature, or the fineness of the extruded filaments but is in general from 20 cm to 50 cm. The atmosphere in the heating zone may be composed of air, nitrogen, or steam, but air is preferred from the viewpoint of economy. If the temperature of the heating zone is lower than 150° C., a satisfactory heating effect cannot be obtained so that spinning at a speed of not less than 7,000 m/min is impossible. If the temperature is higher than 300° C., stable spinning is impossible due to the occurrence of inter-filament fusion or frequent yarn breakage. The temperature of the heating zone herein refers to the temperature of the atmosphere near the filaments in the heating zone.

Figure 4:
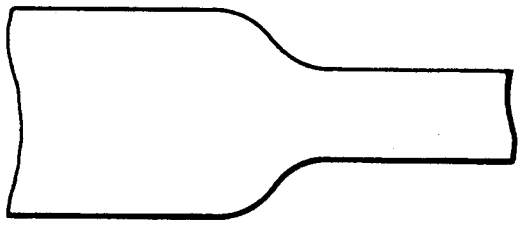
FIG. 4 is a schematic view illustrating the point of completion of fining of a filament being processed by the process according to the present invention.

The group of filaments is bundled by means of a bundling guide positioned at least 5 cm beneath the point of completion of filament fining after the fining of individual filaments is completed within or below the heating zone. In high-speed spinning in which molten polyethylene terephthalate is extruded from a spinneret and the thus-formed filaments are taken up at a speed of not less than about 5,000 m/min, there is known, for example, from G. Perez and C. Lecluse, "International Man-Made Fibers Conference", Dornbirn, Austria, 1979 the existence of a point at which the extruded filaments suddenly become fine during spinning so that they have a fineness finally desired. In the present invention, this point is confirmed, and this point herein is referred to as the point of completion of filament fining. FIG. 4 illustrates the shape of a filament near the point of completion of filament fining of filaments obtained at a spinning speed of 5,400 m/min, described in the abovementioned publication.

In the process of the present invention, the air drag imposed on the filaments can be greatly reduced by the bundling of the group of filaments through the bundling guide so that the occurrence of filament breakage is extremely reduced, and, thus, very stable spinning becomes possible. If the bundling guide is positioned less than 5 cm beneath the point of completion of filament fining, the filaments may be brought into contact with each other above the point of completion of filament fining so that filament breakage often occurs, and, thus, spinning becomes very unstable.

The air drag increases in proportion to the distance between the point of completion of filament fining and the bundling guide. Thus, the tension imposed on the group of filaments 5 cm beneath the bundling guide may vary depending on the position of the bundling guide. In this connection, in the process of the present invention, it is necessary that the tension imposed on the filament bundle 5 cm beneath the bundling guide be not more than 0.4 g/d, preferably not more than 0.3 g/d. If the tension is more than 0.4 g/d, filament breakage often occurs, and a package of a good package form quality can not be obtained, even if a take-up unit is located in the vicinity of the bundling guide, unless godet rolls are used.

The use of a bundling guide as mentioned above may cause filament breakage due to the friction between the guide surface and the filaments, depending upon the material of the guide. Therefore, it is preferable that the group of filaments be bundled while being oiled, using an oiling nozzle guide as the bundling guide. By oiling the filaments with an oiling nozzle guide while bundling; the friction between the group of filaments and the oiling nozzle guide can be reduced, and, in addition, the filaments can be cooled concurrently with the bundling thereof so that inter-filament fusion or adhesion can be avoided. Of course, this oiling can be the oiling necessary for the finishing of a multifilament yarn.

Figure 5A:
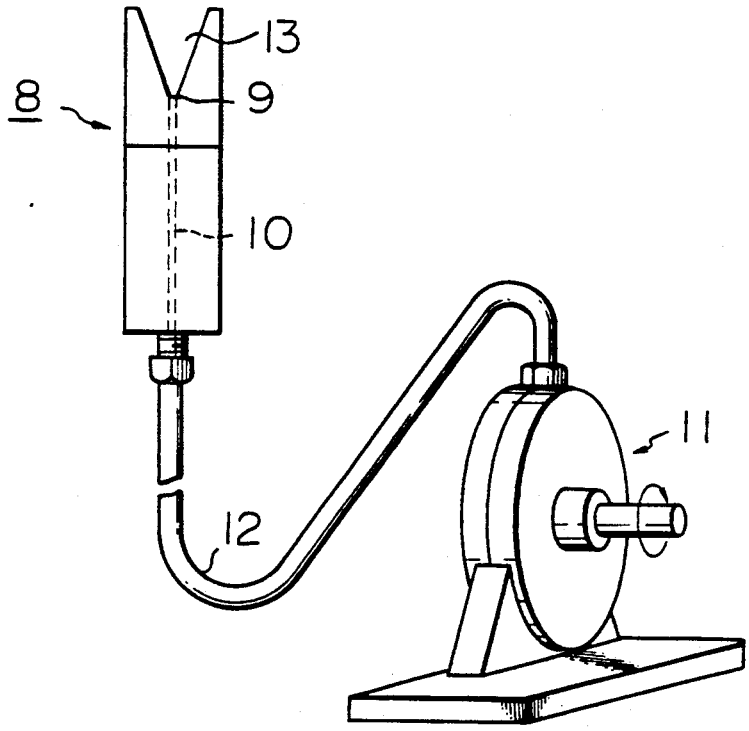
FIG. 5A is a schematic plan view illustrating an oiling nozzle guide arrangement usable for the present invention.
Figure 5B:
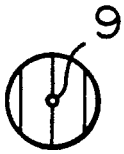
FIG. 5B is a schematic front view of the oiling nozzle part of the guide arrangement shown in FIG. 5A.

An example of the oiling nozzle guide usable for the present invention is illustrated in FIGS. 5A and 5B. The oiling nozzle guide 8 has a cut 13 of a V or U shape at the end thereof and a nozzle 9 at the bottom of the cut 13. The nozzle 9 is connected to a metering gear pump 11 for feeding an oiling agent via an oil path 10 and a hose 12. The guide 8 can act to guide and bundle the filaments and to apply the oiling agent metered and fed to the guide 8 by the gear pump 11 to the filaments.

In the process according to the present invention, the filament bundle may optionally be subjected to entangling treatment by turbulent air between the bundling guide and the take-up unit. The oiling nozzle guide, take-up unit, and other devices necessary for melt spinning may be known devices. Also, the oiling agent usable for the present invention may be an emulsion-type or neat-type oiling agent and may have a known composition.

The surface area per unit weight of the polyethylene terephthalate fiber according to the present invention may be controlled by suitably adjusting the fineness of the filaments by changing the extrusion rate of polyethylene terephthalate or by changing the spinning speed or by suitably defining the cross section of the filaments by changing the shape of the holes of the spinneret.

According to the process of the present invention, polyethylene terephthalate can be stably spun into a fiber of not more than about 4 deniers at a high speed of 7,000 m/min, and a package of a good package form quality can be obtained without using godet rolls. The obtained fiber can be practically used as such without subjecting it to drawing and has an excellent dyeability so that a false-twisted fiber obtained therefrom can be dyed under normal pressure.

The polyethylene terephthalate fiber according to the present invention may be subjected to false twisting by using any conventional false-twisting machines or draw-false-twisting machines. The false-twisting machines may be spindle-type or friction-type false-twisting machines. In the examples described hereinbelow, the dyeability of a polyethylene terephthalate fiber was evaluated after the fiber was subjected to false twisting under optimum conditions.

The following are methods for measuring parameters for specifying the structural properties referred to in the present invention.

Dyeability

The dyeability is evaluated by the degree of equilibrium dye absorption. A sample is dyed with a disperse dye, Resolin Blue FBL (tradename of Bayer A.G.), at a dye concentration of 3% o.w.f., at a liquor-to-goods ratio of 50:1, and at a temperature of 100° C. Further, a dispersing agent, Disper TL (tradename of Marybishi Yuka Co.), is added to the dye bath in an amount of 1 g/l, which dye bath is adjusted to a pH of 6 by adding acetic acid. The employed sample is a fabric knitted on a knitting machine with one feeder using an untextured yarn or a false-twisted yarn which has been scoured in water containing 2 g/l of Scourol FC (tradename of Kao-Atlas Co.) at 60° C. for 20 minutes, dried, and conditioned at 65% R.H. and 20° C. After dyeing for one hour at the dyeing temperature, the amount of dye remaining in the dye bath is determined by measuring the absorbance, and the degree of dye absorption (%) is calculated by subtracting the amount of the remaining dye from the initial amount of the employed dye, dividing the difference by the initial amount of dye, and multiplying the result by 100.

The term "a fiber can be dyed under normal pressure" as used herein means that a fiber can be dyed to a degree of equilibrium dye absorption, as defined above, of 85% or more.

Dynamic Loss Tangent (tan δ)

Figure 3:
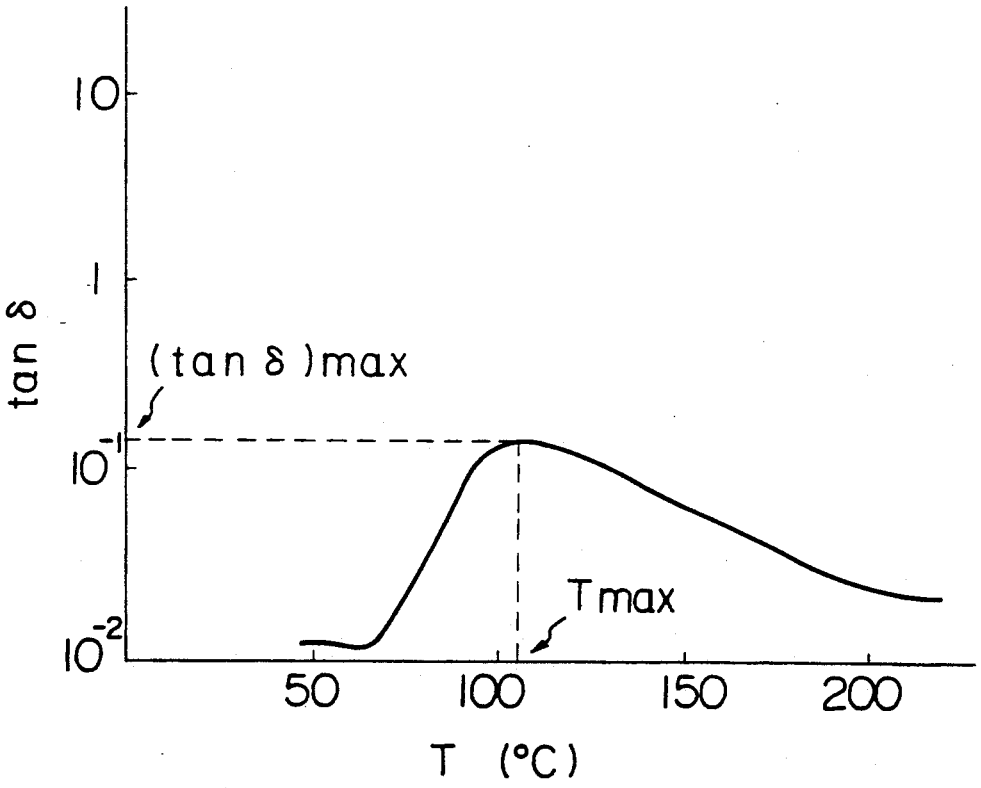
FIG. 3 is a (graph schematically illustrating the dynamic loss tangent (tan δ)-temperature (T) curve.

The dynamic loss tangent (tan δ) is determined by using an apparatus for measuring dynamic viscoelasticity, Rheo-Vibron DDV-IIc, manufactured by Toyo Baldwin Co., at a sample amount of 3.1 mg and at a frequency of 110 Hz in dry air at a temperature increasing at a rate of 10° C./min. Thus, a tan δ-temperature curve as schematically illustrated in FIG. 3 is obtained. From the curve, the peak temperature ($T_{max}$) at which tan δ becomes maximum and the maximum tan δ value $(\tan \delta)_{max}$ are determined.

Initial Modulus

The initial modulus is determined by measuring the tensile stress (g/d at 1% elongation with a tensile tester under the conditions of a yarn length of 10 cm, a stress rate of 5 cm/min, and a chart speed of 250 cm/min at a temperature of 25° C. and a relative humidity of 60%.

Tensile Strength and Elongation

The tensile strength and elongation are measured with a tensile tester under the conditions of a yarn length of 25 cm and a stress rate of 30 cm/min.

Shrinkage in Boiling Water

Shrinkage in boiling water is determined by the following formula:

$$\text{Shrinkage in boiling water (\%)} = \frac{L_0 - L}{L} \times 100$$

In the formula $L_0$ is the length of a sample under a load of 0.1 g/d, and L is the length of the sample under a load of 0.1 g/d after the sample is dipped in boiling water for 30 minutes without the load.

Intrinsic Viscosity $\eta_{sp}/c$ at 35° C., varying the concentration of the polymer and using o-chloropnenol as the solvent, and extrapolating the $\eta_{sp}/c$ to a concentration of 0.

The present invention is further described below with reference to the following non-limitative examples.

EXAMPLE 1

Figure 2:
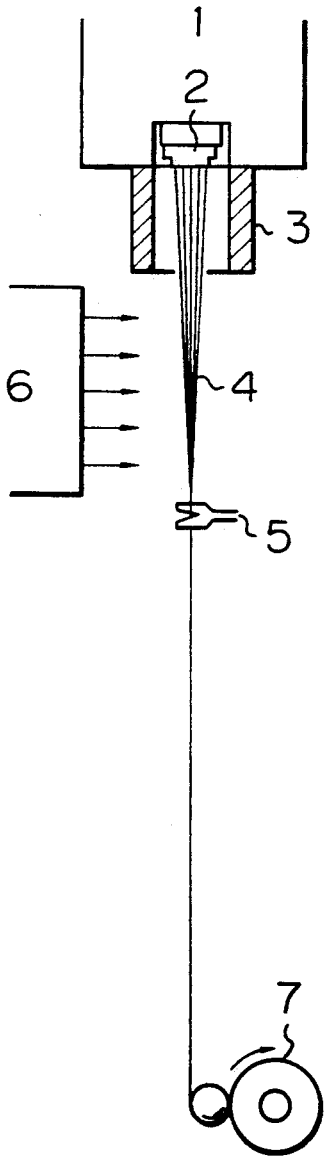
FIG. 2 is a schematic view illustrating an embodiment of an apparatus to be employed in the process according to the present invention, which apparatus has no godet rolls.

A polyethylene terephthalate containing 0.5% by weight of titanium oxide and having an intrinsic viscosity of 0.61 was melt spun at various spinning speeds by using the spinning machine illustrated in FIG. 2. The spinning machine had a spinneret of 24 holes having a diameter of 0.23 mm, a heating cylinder of a length of 30 cm, and a high-speed take-up unit positioned 3 m beneath the spinneret surface. A polyethylene terephthalate multifilament of 50 deniers/24 filaments was obtained. The individual filaments had a surface area per unit weight of 2,035 $cm^2/g$. The temperature of the spinneret head was 300° C., and the temperature in the heating cylinder (the temperature in the heating zone) was 250° C. The oiling nozzle guide illustrated in FIGS. 5A and 5B was positioned 25 cm beneath the point of completion of fining of the filaments.

The peak temperature ($T_{max}$), maximum tan δ value $(\tan \delta)_{max}$, initial modulus, tensile strength at breakage, elongation at breakage, and shrinkage in boiling water of the resultant multifilament were evaluated. The results are shown in Tables 1 and 2. The multifilament was then false twisted under the conditions shown in Table 3, and the dyeability of the multifilament before and after false twisting was evaluated. The results are shown in Table 2.

TABLE 1

| Run No. | Spinning Speed (m/min) | Tensile Strength at Breakage (g/d) | Elongation at Breakage (%) | Initial Modulus (g/d) | Shrinkage in Boiling Water (%) |
|---|---|---|---|---|---|
| 1 | 6.000 | 4.3 | 54 | 67 | 3.0 |
| 2 | 7.000 | 4.1 | 41 | 82 | 2.5 |
| 3 | 8.000 | 4.0 | 28 | 93 | 2.1 |
| 4 | 9.000 | 3.8 | 19 | 95 | 2.0 |
| 5 | 10.000 | 3.5 | 14 | 94 | 2.0 |

TABLE 2

| Run No. | Spinning Speed (m/min) | $T_{max}$ (°C.) | $(\tan \delta)_{max}$ | Dyeability (%) Before False Twisting | Dyeability (%) After False Twisting |
|---|---|---|---|---|---|
| 1 | 6.000 | 112 | 0.200 | 61 | 75 |
| 2 | 7.000 | 111 | 0.176 | 70 | 85 |
| 3 | 8.000 | 110 | 0.172 | 81 | 90 |
| 4 | 9.000 | 109 | 0.159 | 85 | 94 |
| 5 | 10.000 | 107 | 0.154 | 86 | 95 |

TABLE 3

| | |
|---|---|
| Number of revolutions of spindle | 312.000 rpm |
| Number of twists | 3,500 T/m |
| Yarn speed | 89 m/min |
| Temperature of false-twisting heater | 220° C. |
| Overfeed percentage | +3% |
| Temperature of setting heater | 200° C. |
| Overfeed percentage at setting | +17.5% |

From the results, it was confirmed that if a polyethylene terephthalate multifilament has a surface area per unit weight of 2,035 $cm^2/g$, a $T_{max}$ ranging from 105° C. to 115° C., and a $(\tan \delta)_{max}$ of less than 0.190, the false-twisted yarn can be dyed under normal pressure, i.e., at 100° C.

EXAMPLE 2

A polyethylene terephthalate containing 0.5% by weight of titanium oxide and having an intrinsic viscosity of 0.61 was melt spin, at various spinning speeds, by using the spinning machine illustrated in FIG. 2. The spinning machine had a spinneret of 12 holes of a diameter of 0.35 mm, a heating cylinder of a length of 20 cm, and a high-speed take-up unit positioned 3 m beneath the spinneret surface. A polyethylene terephthalate multifilament of 50 deniers/12 filaments was obtained. The individual filaments had a surface area per unit weight of 1,400 $cm^2/g$. The temperature of the spinneret head was 295° C., and the temperature of the heating cylinder (the temperature in the heating zone) was 235° C. The oiling nozzle guide illustrated in FIGS. 5A and 5B was positioned 20 cm beneath the point of completion of fining of the filaments.

The $T_{max}$, $(\tan \delta)_{max}$, initial modulus, tensile strength at breakage, elongation at breakage and shrinkage in boiling water of the resultant multifilament were evaluted. The results are shown in Tables 4 and 5. The multifilament was then false twisted under the conditions shown in Table 3, and the dyeability of the false-twisted multifilament was evaluated. The results are shown in Table 5.

TABLE 4

| Run No. | Spinning Speed (m/min) | Tensile Strength at Breakage (g/d) | Elongation at Breakage (%) | Initial Modulus (g/d) | Shrinkage in Boiling Water (%) |
|---|---|---|---|---|---|
| 6 | 6,000 | 4.2 | 66 | 51 | 3.4 |
| 7 | 7,000 | 4.1 | 54 | 64 | 3.0 |
| 8 | 8,000 | 3.8 | 39 | 83 | 2.8 |
| 9 | 9,000 | 3.6 | 29 | 91 | 2.5 |
| 10 | 10,000 | 3.4 | 19 | 90 | 2.6 |

TABLE 5

| Run No. | Spinning Speed (m/min) | $T_{max}$ (°C.) | $(\tan \delta)_{max}$ | Dyeability After False Twisting (%) |
|---|---|---|---|---|
| 6 | 6,000 | 117 | 0.224 | 56 |
| 7 | 7,000 | 116 | 0.151 | 74 |
| 8 | 8,000 | 113 | 0.135 | 85 |
| 9 | 9,000 | 112 | 0.131 | 89 |
| 10 | 10,000 | 111 | 0.125 | 88 |

From the results, it was confirmed that if a polyethylene terephthalate multifilament has a surface area per unit weight of 1,400 $cm^2/g$, a $T_{max}$ ranging from 111° C. to 115° C., and a $(\tan \delta)_{max}$ of not more than 0.135, the false-twisted yarn can be dyed under normal pressure at 100° C.

EXAMPLE 3

A polyethylene terephthalate containing 0.5% by weight of titanium oxide and having an intrinsic viscosity of 0.61 was melt spun, at various spinning speeds, by using the spinning machine illustrated in FIG. 2. The spinning machine had a spinneret of 36 holes of a diameter of 0.23 mm, a heating cylinder of a length of 30 cm, and a high-speed take-up unit positioned 3 m beneath the spinneret surface. A polyethylene terephthalate multifilament of 75 deniers/36 filaments was obtained. The individual filaments had a surface area per unit weight of 2,035 $cm^2/g$. The temperature of the spinneret head was 295° C., and the temperature of the heating cylinder (the temperature in the heating zone) was 250° C. An oiling nozzle guide illustrated in FIGS. 5A and 5B was positioned 25 cm beneath the point of completion of fining of the filaments.

The $T_{max}$, $(\tan \delta)_{max}$, initial modulus, tensile strength at breakage, elongation at breakage, and shrinkage in boiling water of the resultant multifilament were evaluated. The results are shown in Tables 7 and 8. The multifilament was then false twisted under the conditions shown in Table 6, and the dyeability of the false-twisted multifilament was evaluated. The results are shown in Table 8.

TABLE 6

| | |
|---|---|
| Number of revolutions of spindle | 314,000 rpm |
| Number of twists | 3,180 T/m |
| Yarn speed | 99 m/min |
| Temperature of false-twisting heater | 220° C. |
| Overfeed percentage | +1% |
| Temperature of setting heater | 200° C. |
| Overfeed percentage at setting | +17.5% |

TABLE 7

| Run No. | Spinning Speed (m/min) | Tensile Strength at Breakage (g/d) | Elongation at Breakage (%) | Initial Modulus (g/d) | Shrinkage in Boiling Water (%) |
|---|---|---|---|---|---|
| 11 | 6,000 | 4.2 | 61 | 61 | 3.1 |
| 12 | 7,000 | 4.1 | 48 | 74 | 2.9 |
| 13 | 8,000 | 3.9 | 30 | 90 | 2.8 |

TABLE 8

| Run No. | Spinning speed (m/min) | $T_{max}$ (°C.) | $(\tan \delta)_{max}$ | Dyeability After False Twisting (%) |
|---|---|---|---|---|
| 11 | 6,000 | 118 | 0.200 | 71 |
| 12 | 7,000 | 113 | 0.190 | 85 |
| 13 | 8,000 | 106 | 0.138 | 90 |

EXAMPLE 4

Figure 6A:
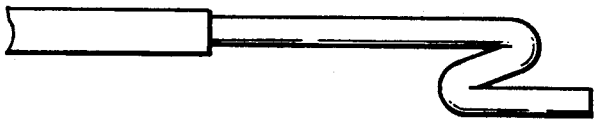
FIG. 6A is a schematic side view of a bundling guide usable for the present invention.
Figure 6B:
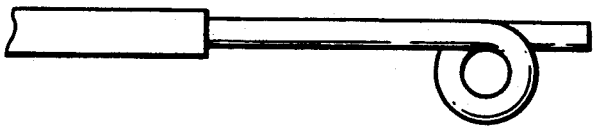
FIG. 6B is a schematic plan view of the bundling guide shown in FIG. 6A.

A polyethylene terephthalate having an intrinsic viscosity of 0.61 and a melting point of 255° C. was melt spun, at a spinning speed of 8,000 m/min, into a multifilament of 75 deniers/36 filaments by using the melt-spinning machine illustrated in FIG. 2, the length and temperature of the heating cylinder and the position of the oiling nozzle guide or the bundling guide being varied as shown in Table 9. In Run Nos. 14 to 25, the bundling guide illustrated in FIGS. 6A and 6B was used, and in Run Nos. 26 to 28, the oiling nozzle guide illustrated in FIGS. 5A and 5B was used. The employed spinneret had 36 holes of a diameter of 0.23 mm and a temperature of 290° C. The take-up unit was positioned 2 m beneath the oiling nozzle guide or the bundling guide. The point of completion of fining of the filaments as shown in Table 9 was confirmed by measuring with a DIAMETER-MONITOR 463A/2 (tradename of Zimmer A.G.) the diameter of the filaments being spun. The evaluated spinning stability and package form quality are shown in Table 9. In the table, Run Nos. 15, 16, 17, 19, 20, 21, 22, 23, 24, 26, 27, and 28 fall within the range of the present invention, in which the spinning stability and package form quality are both excellent or good.

TABLE 9

| Run No. | Length of Heating Cylinder (cm) | Temperature of Heating Cylinder (°C.) | Position of Filament-Fining Completion Point (cm) | Position of Guide (cm) | Tension at 5 cm beneath Guide (g/d) | Spinning Stability | Package Form Quality |
|---|---|---|---|---|---|---|---|
| 14 | 3 | 260 | 36 | 85 | — | x | — |
| 15 | 5 | 260 | 42 | 90 | 0.34 | c | o |
| 16 | 20 | 260 | 58 | 105 | 0.31 | c | ⊙ |
| 17 | 40 | 260 | 70 | 120 | 0.33 | c | c |
| 18 | 20 | 140 | 35 | 85 | — | x | — |
| 19 | 20 | 170 | 45 | 95 | 0.30 | c | ⊙ |
| 20 | 20 | 220 | 52 | 100 | 0.29 | c | ⊙ |
| 21 | 20 | 300 | 66 | 115 | 0.30 | c | c |

TABLE 9-continued

| Run No. | Length of Heating Cylinder (cm) | Temperature of Heating Cylinder (°C.) | Position of Filament-Fining Completion Point (cm) | Position of Guide (cm) | Tension at 5 cm beneath Guide (g/d) | Spinning Stability | Package Form Quality |
|---|---|---|---|---|---|---|---|
| 22 | 20 | 170 | 45 | 50 | 0.13 | : | : |
| 23 | 20 | 170 | 45 | 60 | 0.17 | : | ⊙ |
| 24 | 20 | 170 | 45 | 80 | 0.27 | ⊙ | ⊙ |
| 25 | 20 | 170 | 45 | 110 | — | x | — |
| 26 | 5 | 260 | 42 | 90 | 0.34 | ⊙ | ⊙ |
| 27 | 20 | 260 | 58 | 105 | 0.34 | ⊙ | ⊙ |
| 28 | 40 | 260 | 70 | 120 | 0.34 | ⊙ | ⊙ |

Note:
The position of the filament-fining completion point was measured from the spinneret surface. The position of the guide was also measured from the spinneret surface. The spinning stability was evaluated in the following manner:
⊙ Excellent (there was little yarn breakage or filament breakage)
: Good (yarn breakage or filament breakage sometimes occurred)
x Poor (yarn breakage often occurred and spinning was difficult)
The package form quality was evaluated in the following manner:
⊙ Excellent (there was no yarn layer breakage at the end surface and no package deformation)
: Good (a little yarn layer breakage occurred at the end surface but there was no package deformation)
x Poor (package deformation occurred)

EXAMPLE 5

A polyethylene terephthalate having an intrinsic viscosity of 0.61 and a melting point of 255° C. was melt spun, at a spinning speed of from 5,000 to 8,000 m/min, into a multifilament of 75 deniers/36 filaments by using the melt-spinning machine illustrated in FIG. 2. In all the runs, the bundling guide illustrated in FIGS. 6A and 6B was used. The other conditions were identical to those in Example 4.

The results are shown in Table 10. In Run Nos. 29 to 32, which fall within the range of the present invention, the spinning stability and package form quality were both excellent.

The false-twisted yarns obtained from the resultant multifilaments of Run Nos. 29 to 32 could be dyed under normal pressure.

TABLE 10

| Run No. | Spinning Speed (m/min) | Length of Heating Cylinder (cm) | Temperature of Heating Cylinder (°C.) | Position of Filament-Fining Completion Point (cm) | Position of Guide (cm) | Tension 5 cm Beneath Guide (g/d) | Spinning Stability | Package Form Quality |
|---|---|---|---|---|---|---|---|---|
| 29 | 5,000 | 20 | 190 | 72 | 130 | 0.25 | ⊙ | ⊙ |
| 30 | 6,000 | 20 | 190 | 63 | 110 | 0.25 | ⊙ | ⊙ |
| 31 | 7,000 | 20 | 190 | 54 | 90 | 0.24 | ⊙ | ⊙ |
| 32 | 8,000 | 20 | 190 | 48 | 80 | 0.26 | ⊙ | ⊙ |

We claim:

1. A process for preparing polyethylene terephthalate fiber, comprising the steps of:

1) melt-spinning polyethylene terephthalate through a spinneret having a plurality of spinning holes at a spinning speed of not less than 7,000 m/min,
2) passing a group of said extruded filaments through a heating zone defined over a length of not less than 5 cm from the bottom of the spinneret, the atmosphere in said heating zone near said filaments being maintained at a temperature of from 150° C. to 300° C., and
3) bundling said filaments into a filament bundle by means of a bundling guide positioned so as to satisfy the following conditions (a) and (b):
   (a) said position of said bundling guide should be not less than 5 cm beneath the point of completion of fining of the group of filaments, and
   (b) the tension imposed on the filament bundle 5 cm beneath said position of the bundling guide should be not more than 0.4 g/d.

2. A process as claimed in claim 1, wherein the length of the heating zone ranges from 20 cm to 50 cm.

3. A process as claimed in claim 1, wherein the temperature of the heating zone ranges from 190° C. to 300° C.

4. A process as claimed in claim 1 wherein an oiling nozzle guide is used as the bundling guide, and the group of filaments is bundled while being oiled into a filament bundle.

5. A process as claimed in claim 1, wherein the bundling guide is positioned so that the tension imposed on the filament bundle 5 cm beneath the bundling guide is not more than 0.3 g/d.

* * * * *